US008617658B2

(12) United States Patent
Lee et al.

(10) Patent No.: US 8,617,658 B2
(45) Date of Patent: Dec. 31, 2013

(54) METHOD AND APPARATUS FOR CONDUCTING FILM COATING ON SURFACE OF SPINNING CIRCULAR WORKPIECE UNDER ACTION OF GAS PRESSURE, AND NOZZLE UTILIZED IN THE SAME

(75) Inventors: Yung-Chun Lee, Tainan County (TW); Chuan-Hsiang Lee, Kaohsiung (TW); Shou-Chi Cho, Tainan County (TW)

(73) Assignee: National Cheng Kung University, Tainan (TW)

( * ) Notice: Subject to any disclaimer, the term of this patent is extended or adjusted under 35 U.S.C. 154(b) by 706 days.

(21) Appl. No.: 12/732,661

(22) Filed: Mar. 26, 2010

(65) Prior Publication Data

US 2011/0236584 A1 Sep. 29, 2011

(51) Int. Cl.
*B05D 3/04* (2006.01)
*B05D 3/12* (2006.01)

(52) U.S. Cl.
USPC ..... 427/348; 118/63; 118/318; 118/320; 427/233; 427/236; 427/237; 427/425

(58) Field of Classification Search
USPC ..... 118/50, 55, 56, 63, 318, 320, 409; 427/231, 238, 348, 349, 350, 369, 425
See application file for complete search history.

(56) References Cited

U.S. PATENT DOCUMENTS 3,968,279 A * 7/1976 Brown et al. ..... 427/348
4,092,953 A * 6/1978 Waugh ..... 118/642

* cited by examiner

*Primary Examiner* — Alexander Weddle
(74) *Attorney, Agent, or Firm* — Rosenberg, Klein & Lee

(57) ABSTRACT

This invention relates to a method for conducting film coating on the surface of spinning circular workpiece under action of gas pressure, and nozzle utilized in the same. Circular workpiece to be coated is held on a rotating mechanism, and a feedstock loading machine having a nozzle, which is capable of guiding redundant feedstock and overflowing in a specific direction, is set to have a 100 μm gap with the circular workpiece. When the rotating mechanism is rotated, the polymer solution is precoated on the surface of the circular workpiece, and when gas valve is opened, the polymer solution is squeezed to a predetermined thickness by an annular high pressure gas-stream formed on the periphery of a cylinder, produced from the high pressure gas released.

6 Claims, 14 Drawing Sheets

| point(cm) | 1 | 4 | 7 | 10 | 13 |
|---|---|---|---|---|---|
| film thickness(um) | 2.0 | 1.8 | 1.8 | 2.1 | 1.9 |
FIG. 12(a)
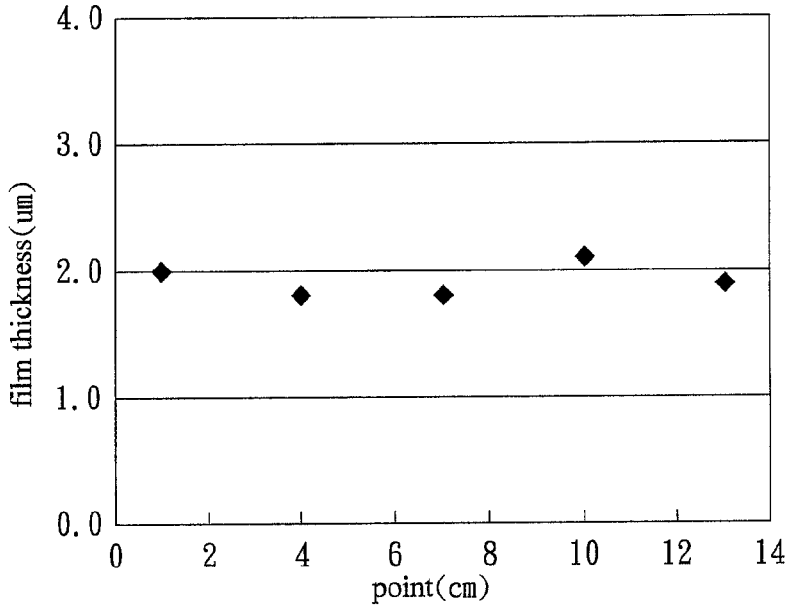
FIG. 12(b)
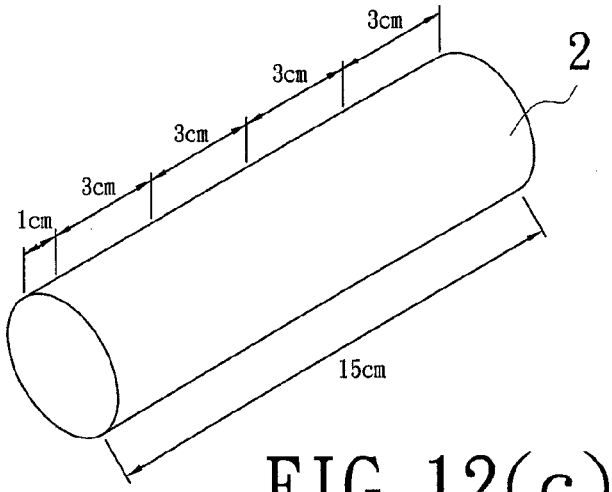
FIG. 12(c)

METHOD AND APPARATUS FOR CONDUCTING FILM COATING ON SURFACE OF SPINNING CIRCULAR WORKPIECE UNDER ACTION OF GAS PRESSURE, AND NOZZLE UTILIZED IN THE SAME

BACKGROUND OF THE INVENTION

1. Field of the Invention

The present invention relates to a method for conducting film coating on the surface of spinning circular workpiece under the action of gas pressure and a nozzle utilized in the same, more particularly to a novel technology of uniformly coating a film having nano-scale thickness on the surface of circular workpiece.

2. Brief Description of the Prior Art

So far, there are substantially two methods of coating polymer solution on the surface of circular workpiece, one is spray coating method and the other one is blade coating method.

In the spray coating method, polymer solution (for example, photoresist, UV resin) is firstly filled in spray gun, and then the polymer solution is atomized into mist droplets after passing through the spray gun, in turn the mist droplets is sprayed by high-pressure gas onto the surface of a circular workpiece so as to finish the coating of the circular workpiece. However, in the spray coating method, the outlet pressure of spray gun has a Gaussian distribution (clustering around center and is thin outside the center), hence mist droplets is failed to be uniformly distributed especially when the mist droplets is in nano-scale size. Therefore, the spray coating method cannot produce polymer film having highly uniform thickness below 1 μm.

Referring to FIG. 13, the blade coating method is essentially to use a doctor blade (7) to wipe redundant polymer solution (9) off the surface of the circular workpiece (8), and the thickness of the polymer solution coating is determined by adjusting the gap between the doctor blade (7) and the circular workpiece (8). The method of wiping off redundant polymer solution (9) by the doctor blade (7) can reach certain extent of uniformity in the blade coating technology, but the doctor blade (7) usually in mechanical feeding can hardly reach a distance of less than 10 μm from the surface of circular workpiece, let alone a displacement precision of 1 μm. Hence, a film of polymer solution having thickness less than 1 μm cannot be achieved by the blade coating method. Moreover, adhesion of the doctor blade (7) on the coated film is often occurred during separation from the circular workpiece (8) such that bad roundness is caused.

SUMMARY OF INVENTION

In view of the abovementioned disadvantages, the present invention has proposed a technology for conducting film coating on the surface of spinning circular workpiece under action of gas pressure as a substitute for spray coating and blade coating method, so as to improve the shortcomings of prior art.

The main object of the present invention is to provide a technology exclusively used for coating circular workpiece, which has the following advantages: polymer solution can be coated onto circular workpiece easily and quickly, and the polymer solution film coated onto circular workpiece has high-uniformity, high-roundness, super-thin film thickness, no seam point.

One of the core technologies of the present invention is to control thickness by gas pressure. For this purpose, a high pressure circular gas-ring having high pressure air or pure nitrogen gas fed therein is formed, and circular workpiece to be coated passes through the circular gas-ring in self-spinning manner such that the high pressure air will squeeze and thus homogenize the polymer solution coated on the circular workpiece. In other words, the squeezing force is adjusted by controlling gas pressure such that film thickness is subject to be changed.

Another one of the core technology of the present invention is to control initial thickness by the gap between the discharge opening and the circular workpiece. In the present invention, the circular workpiece to be coated is held on a spinning mechanism for self-spinning, and the discharge opening is arranged above the circular workpiece. The distance between the discharge opening and the circular workpiece is appropriately adjusted in such a manner that the feedstock contacts with the spinning circular workpiece as soon as it is output from the discharge opening. Hence, polymer solution is precoated on the circular workpiece by the self-spinning of the circular workpiece, and redundant polymer solution exceeding the height of gap can be wiped off by the discharge opening, and then the redundant polymer solution is guided toward the radial and axial directions. Thus, the discharge opening has both functions of feedstock discharge and redundant feedstock wipe-off.

Another one of the core technology of the present invention is to control initial thickness and uniformity by controlling the rotation speed. In the present invention, the circular workpiece to be coated is held on a rotating mechanism for self-spinning, and the rotation speed is adjusted by a digital panel. The rotation speed determines the frequency (in unit time) of circular workpiece's passage through the discharge opening. The faster the rotation speed is, the bigger the frequency of circular workpiece's passage through the discharge opening becomes and the better the uniformity is.

Another one of the core technology of the present invention is to control the uniformity by gap. The gas pressure distribution on the surface of circular workpiece is directly influenced by the size of the gap between the circular workpiece and the gas-ring. Under the same rotation speed and the same gas pressure condition, optimum uniformity of polymer solution film coated on the surface of the circular workpiece can be obtained by a specific gap.

Another one of the core technology of the present invention is to control the uniformity by gas-ring feeding speed. Inasmuch as the redundant polymer solution is squeezed-off by high pressure air, the speed of the circular workpiece passing through the circular gas-ring determines the uniformity of the polymer film produced. The slower the gas-ring feeding speed is, the longer the time of each point on the circular workpiece passing through the squeezing by the gas-ring becomes. Hence, the film thickness becomes more even.

Another object of the present invention is to provide a technology by which different polymer solution can be coated on circular workpiece. Therefore, both the coating material and the primer coating material can be diversified so as to solve the problem encountered in the coating on circular workpiece.

In order to achieve above objects of the present invention, a method for conducting film coating on the surface of spinning circular workpiece under action of gas pressure is provided, comprising at least the following steps:

providing firstly circular workpiece made of any material (for example, steel, glass, polymer), which has to meet some basic requirement on its roundness and straightness;

holding the circular workpiece on a rotating mechanism;

feeding coating material (for example, photoresist, UV resin) in a pump which delivers the coating material stably from a discharge opening provided over the circular workpiece;

adjusting the gap between the discharge opening and the circular workpiece so as to obtain predetermined film thickness;

starting the rotating mechanism so as to allow spinning of the circular workpiece, and the rotation speed is adjusted to a desired value;

setting the pressure of the annular gas-stream, and the annular gas-stream is moved forward in the direction of circular workpiece so that the annular gas-stream is moved relatively with respect to the spinning circular workpiece;

In this manner, the polymer solution is outputted from the discharge opening and is coated onto the surface of the circular workpiece along the direction of rotation by the spinning of the circular workpiece. In turn, the annular gas-stream begins to squeeze the coating material on the circular workpiece so as to reach desired thickness.

In order to achieve above object, an apparatus for conducting film coating on the surface of spinning circular workpiece under action of gas pressure of the present invention is provided, at least comprising:

a rotating mechanism used to hold the circular workpiece in place and to move the circular workpiece into rotation;

a feedstock supply mechanism, which adjusts the flow rate and stably supplies polymer solution to the discharge opening;

an annular gas-stream generating device moved by a translational mechanism toward the direction of the circular workpiece, such that the annular gas-stream generated by the annular gas-stream generating device is moved relatively with respect to the spinning circular workpiece, and the coating material coated on the surface of the circular workpiece is squeezed by the annular gas-stream.

A nozzle is disposed on the discharge opening of the above feedstock supply mechanism. The end surface of the nozzle opposite to the circular workpiece has a guide chute and a portion contacting with the circular workpiece. Redundant feedstock is guided and overflows along the direction of guide chute, and the polymer solution is coated onto the surface of the circular workpiece through the contact portion. In this manner, the polymer solution can be evenly coated throughout the surface of the circular workpiece so as to achieve the effect of surface coating having good uniformity and flatness.

In the technology of conducting film coating on the surface of spinning circular workpiece under action of gas pressure, the gas used in the annular gas-stream can be high pressure air or pure nitrogen gas. Lapping and polishing process should be conducted on the surface of the circular workpiece so as to achieve roundness and straightness below 2 μm. Medium-carbon steel or high-carbon steel can be used as the material for circular workpiece. A gap should be arranged between the circular workpiece and the gas-ring.

Further in the technology of conducting film coating on the surface of spinning circular workpiece under action of gas pressure, the annular gas-stream generating device has a plurality of gas pore provided in equi-distance on the inner surface of a gas-ring, and high pressure gas-stream passes through the gas pores so as to produce annular gas-stream.

Another preferred design of the annular gas-stream generating device is to provide an annular slit on the inner surface of the gas-ring, and high pressure gas-stream passes through the annular slit so as to produce annular gas-stream.

Still another preferred design of the annular gas-stream generating device comprises a hollow cylinder body having an opening on one end thereof, the diameter of the opening is slightly larger than that of the circular workpiece such that the circular workpiece can be put on the hollow cylinder body. The other end of the cylinder body is an input end of high pressure gas. In this manner, annular gas-stream can be produced on the slit formed between the opening of the cylinder and the circular workpiece.

The abovementioned annular gas-stream generating device is implemented in film coating on the outer surface of circular workpiece.

Yet another preferred design of the annular gas-stream generating device is to provide an annular slit on the outer surface of a gas-ring, and high pressure gas-stream passes through the annular slit so as to produce annular gas-stream. The annular gas-stream generating device is suitably to be implemented in film coating on the inner surface of circular workpiece.

The main purpose of utilizing a rotating mechanism (for example, lathe) in the technology of conducting film coating on the surface of spinning circular workpiece under action of gas pressure of the present invention has the following advantages: 1. capable of adjusting rotation speed in digital method. 2. capable of setting automatic gas-ring feeding speed. 3. easy to hold the circular work in more stable manner.

BRIEF DESCRIPTION OF THE DRAWINGS

FIG. 12(*a*) is a table showing the film thickness measured on the surface of the circular workpiece after coating in the present invention;

FIG. 12(*b*) is a graph plotted according to the data in FIG. 12(*a*);

FIG. 12(*c*) is a schematic view showing the measured points on the surface of a circular workpiece after coating.

DETAILED DESCRIPTION OF PREFERRED EMBODIMENT

This invention discloses a method and an apparatus for conducting film coating on the surface of spinning circular workpiece under action of gas pressure, which can coat a coating material onto the outer or the inner surface of circular workpiece quickly and uniformly so that subsequent processes such as eximer laser process, photolithography process can be conducted to define miniature patterns on the circular workpiece for backside application. This invention will become more apparent by the detailed description set forth below in conjunction with accompanying drawings of FIGS. 1 to 13 and components' reference number.

Figure 1:
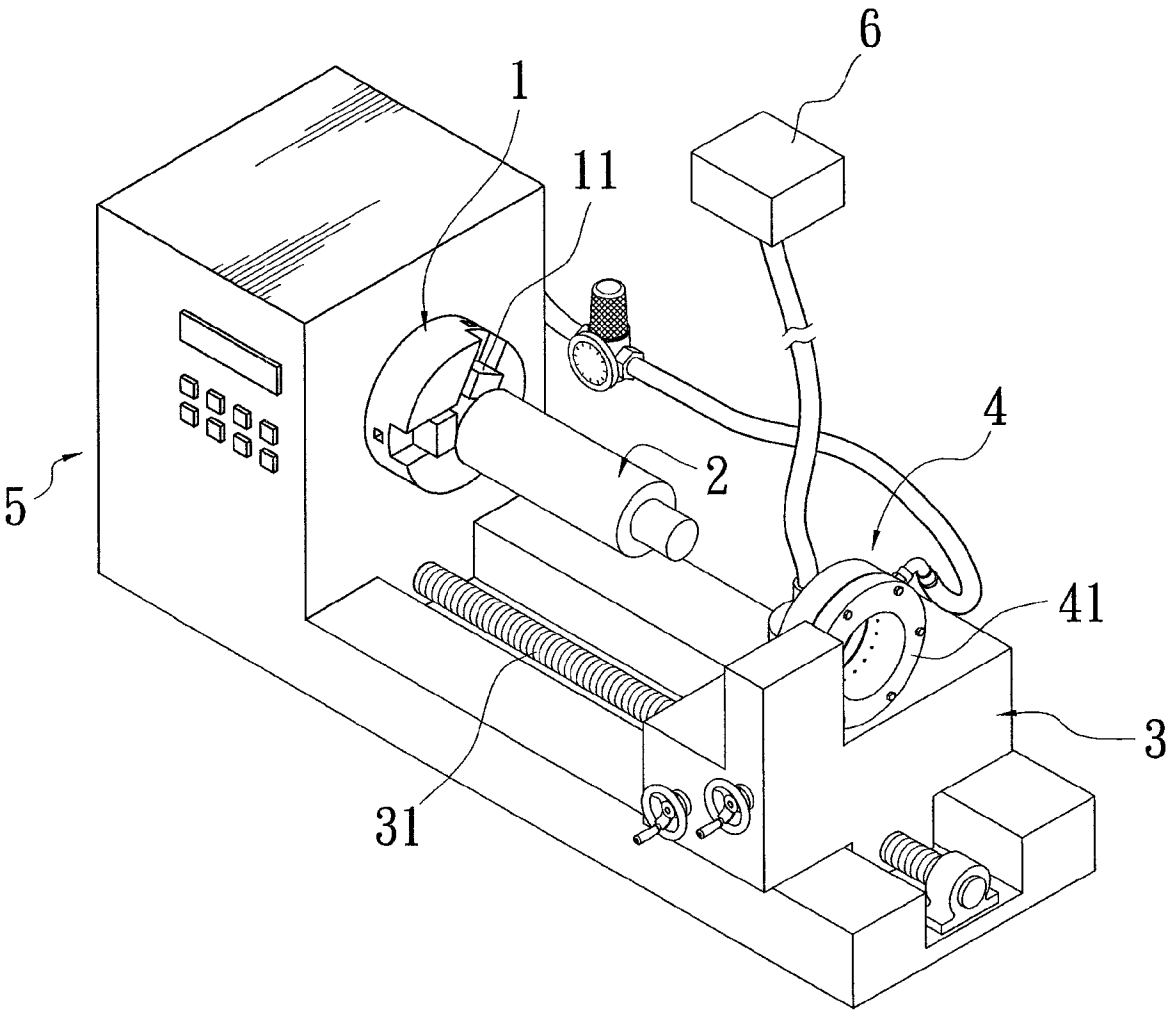
FIG. 1 is a perspective outline view showing the first embodiment of the present invention.
Figure 2:
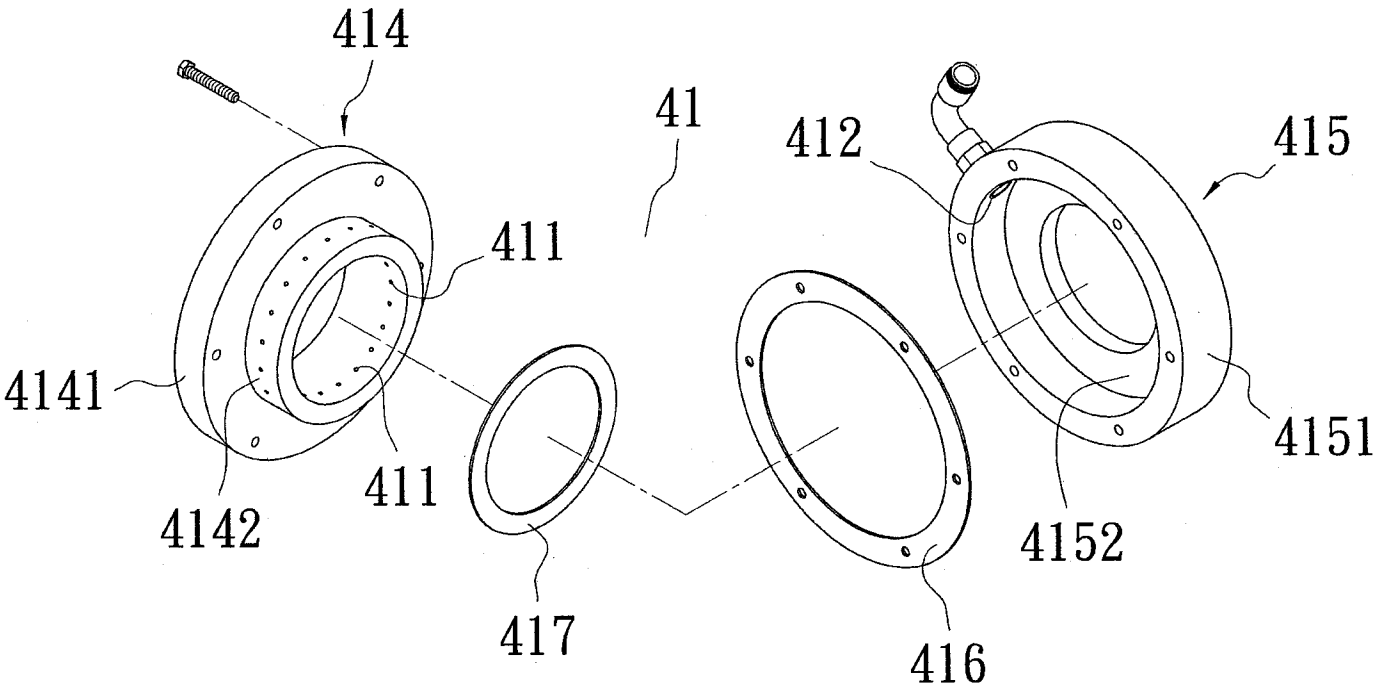
FIG. 2 is a view showing the structure of the first embodiment of the present invention.
Figure 3:
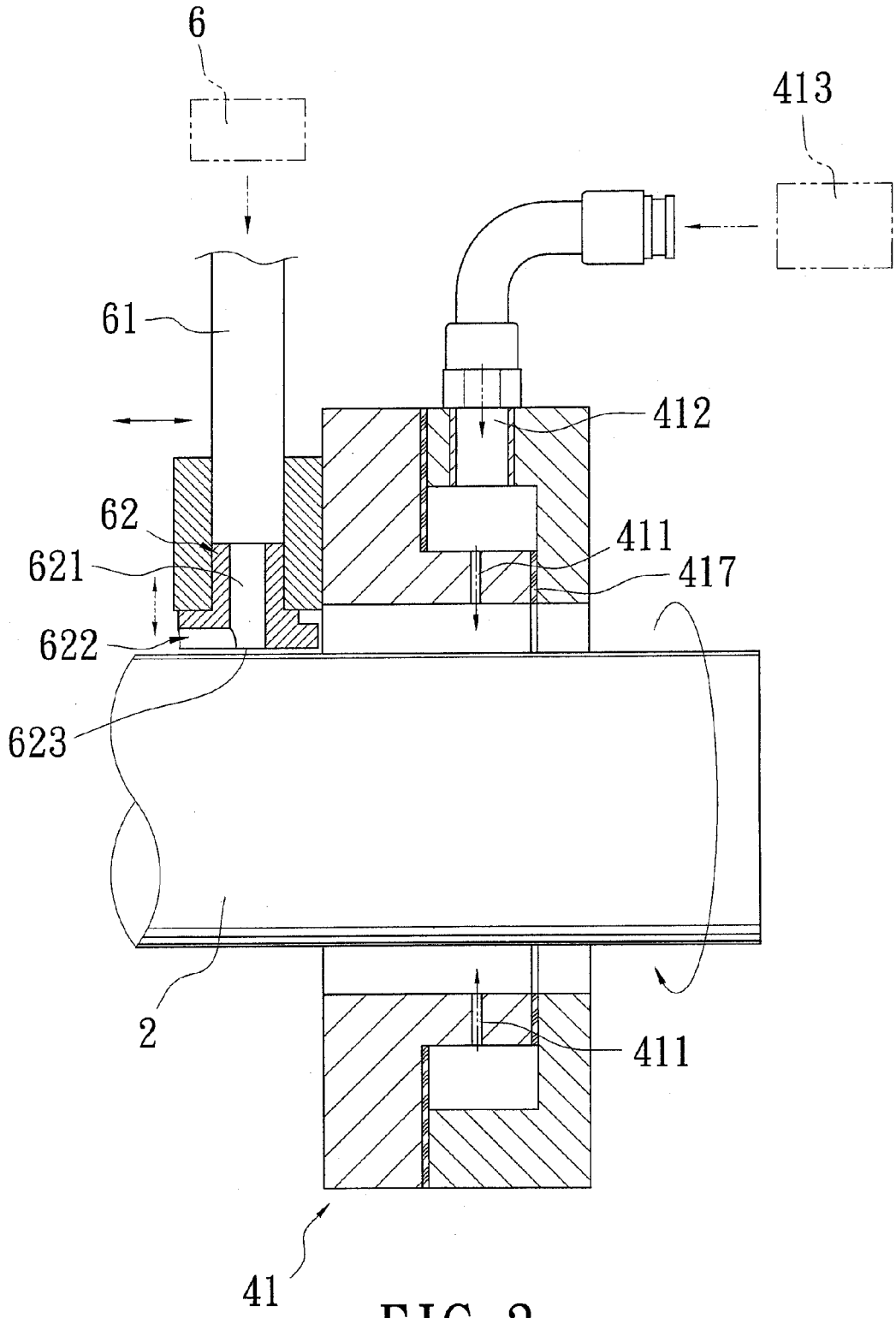
FIG. 3 is a side view showing the structure of the gas-ring and the circular workpiece of the first embodiment of the present invention.

Referring to FIGS. 1 to 3, an apparatus for conducting film coating on the surface of spinning circular workpiece under action of gas pressure of the present invention is shown, at least comprising:

a rotating mechanism (1) provided on a base frame (5), which has a chuck (11) for securely holding a circular workpiece (2);

a translational mechanism (3) also provided on the base frame (5), which has a guide portion (31) for guiding the translational mechanism (3) to move toward the direction of the rotating mechanism (1);

an annular gas-stream generating device (4) for producing annular gas-stream, which is fixed on the translational mechanism (3), the annular gas-stream generating device (4) is driven by the translational mechanism (3) to move toward the direction of the circular workpiece (2) such that the annular gas-stream produced by the annular gas-stream generating device (4) conducts relative movement with respect to the spinning circular workpiece (2) so as to squeeze the coating material coated on the surface of the circular workpiece (2).

Lapping and polishing should be conducted on the circular workpiece (2) so as to reach roundness and straightness less than 2 μm. Hence, the material of the circular workpiece (2) can be one selected from medium-carbon steel, high-carbon steel, any polymer material, organic material, plastic material, semiconductor material, metallic material, quartz, glass material, ceramic material, inorganic material, electrically conducting material, compound of any two above materials, or compound of more than two above materials.

Moreover, this invention comprises a feedstock supply mechanism (6) which supplies desired coating material at a stable flow rate onto the surface of the circular workpiece (2) through the discharge opening (61). The feedstock supply mechanism (6) can be a pressure pump of any type capable of setting its flow rate. The discharge opening (61) is arranged to be above the annular gas-stream generating device (4) by the connection of a gas piping in such a manner that the discharge opening (61) can be displaced accompanying with the displacement of the annular gas-stream generating device (4), so as to coat the material onto the surface of the circular workpiece (2).

Figure 4:
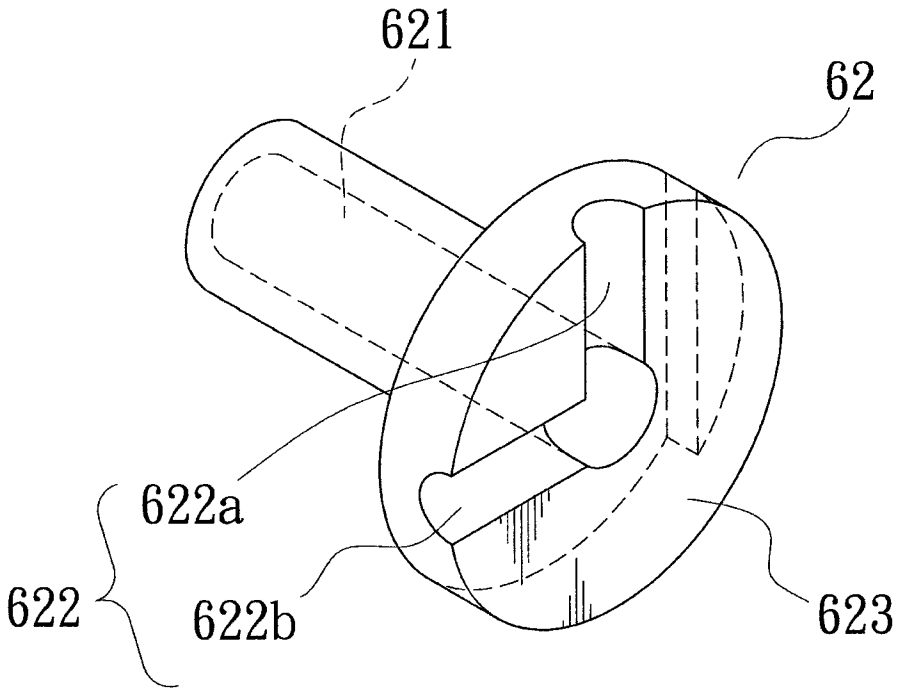
FIG. 4 is a perspective outline view showing the nozzle of the present invention.
Figure 5:
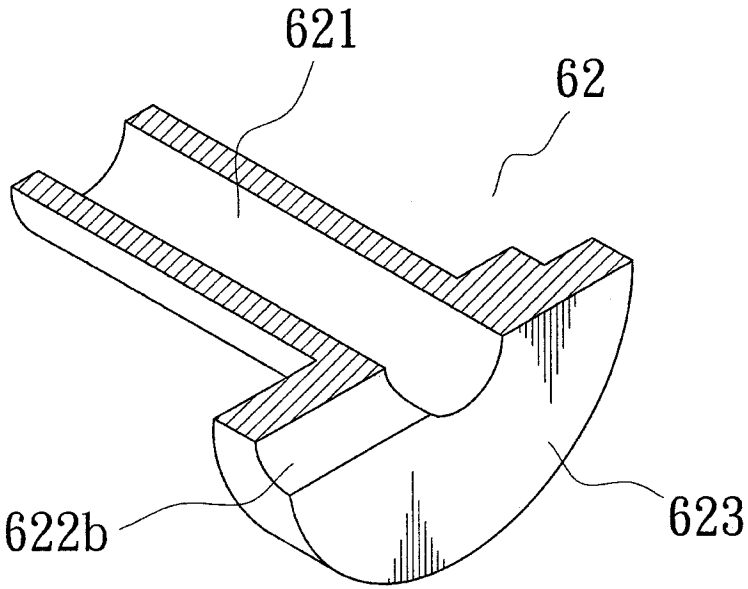
FIG. 5 is a perspective sectional schematic view showing the nozzle of the present invention.
Figure 6:
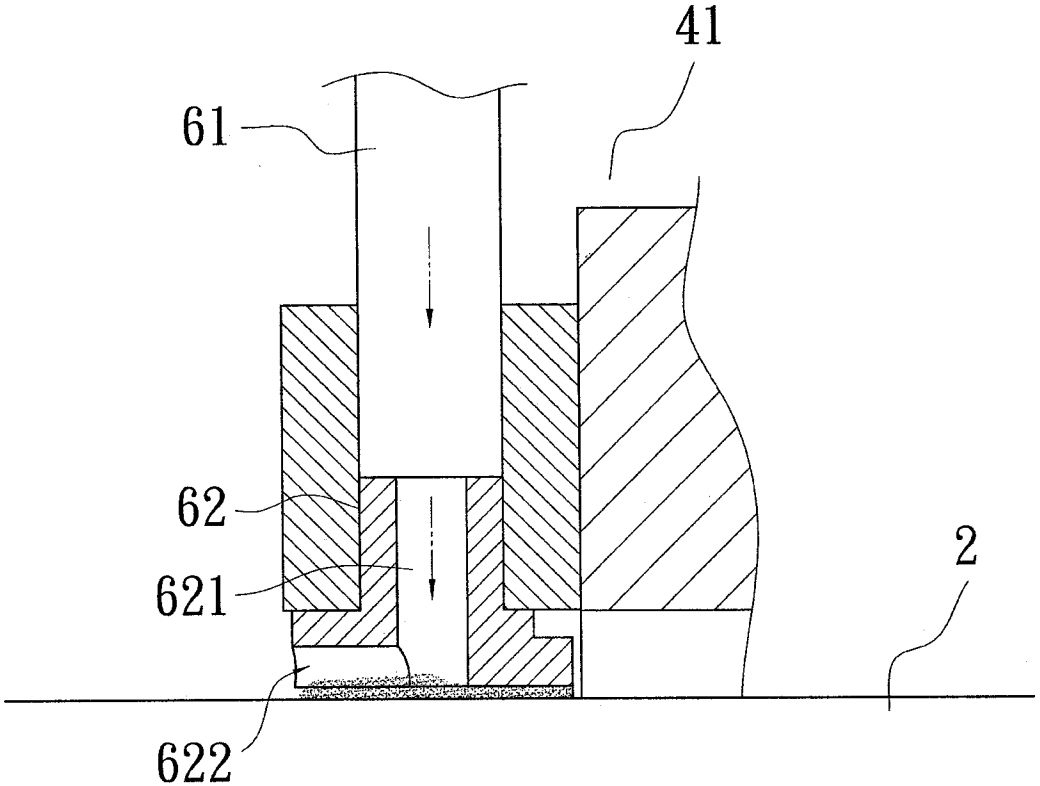
FIG. 6 is a schematic view showing the nozzle of the present invention in using state.

Referring to FIGS. 4 to 6, a nozzle (62) having a passage (621) is provided on the discharge opening (61), through which the polymer material can be coated on the surface of the circular workpiece (2). The end surface of the nozzle (62) opposite to the circular workpiece (2) has a guide chute (622) and a portion (623) contacting with the surface of the circular workpiece (2). The guide chute (622) and the nozzle (62) is in communication with the passage (621) of the discharge opening (61). The guide chute (622) further includes a longitudinal guide chute (622*a*) and a transverse guide chute (622*b*), and the longitudinal and transverse guide chutes (622*a*, 622*b*) are respectively in communication with the passage (621) of the discharge opening (61).

When the feedstock supply mechanism (6) delivers coating material through the discharge opening (61), the feedstock delivered is coated on the surface of the circular workpiece (2) through the passage (621) of the nozzle (62). As soon as the feedstock drops onto the surface, it is closely contacted with the surface of the spinning circular workpiece (2) through the contact portion (623) which functions as a doctor blade for leveling the feedstock on the coated surface of the circular workpiece (2). In the process of coating and leveling, the Redundant feedstock wiped off by the contact portion (623) is further guided by the longitudinal and the transverse guide chutes (622*a*, 622*b*) and is overflowed along the direction of the same, i.e., along the forward direction (transverse direction) and the rotational direction (longitudinal direction). In this manner, the polymer solution can be evenly coated throughout the surface of the circular workpiece so as to achieve surface coating having good uniformity and flatness.

Furthermore, the nozzle (62) can be made of Teflon material (polytetrafluoroethylene) so as to possess anti-acid-alkali and anti-corrosion properties. The nozzle (62) can also be one selected from any polymer material, organic material, plastic material, semiconductor material, metallic material, quartz, glass material, ceramic material, inorganic material, electrically conducting material, compound of any two above materials, or compound of more than two above materials.

A preferred design of the annular gas-stream generating device (4), referring to FIGS. 2 and 3, is formed by an annular gas-ring (41) having a plurality of gas pore (411) arranged in equidistance on the inner surface of the gas-ring (41), and each gas pore (411) is in communication with a gas inlet opening (412) which is connected to a gas supply source (413). When the gas supply source (413) begins to supply high pressure gas, an annular gas-stream is produced at the inner surface of the gas-ring (41) through the gas pores (411) thereon. Further, the gas-ring (41) can be penetrated by the circular workpiece (2), and the gap between the circular workpiece (2) and the gas-ring (41) is 0.5 mm~2 mm.

The gas-ring (41) further includes a first member (414) and a second member (415). The first member (414) is provided with a ring section (4142) on the base section (4141), and the plural gas pores (411) are provided on the ring section (4142). The second member (415) has a ring portion (4151) one end of which has an annular flange (4152) extending toward the axis, and the gas inlet opening (412) is provided on the ring portion (4151). When the first member (414) is fastened with the second member (415), one face of the base section (4141) of the first member (414) abuts against one end of the ring portion (4151) of the second member (415) and a gasket (416) is disposed therebetween. Simultaneously, one end of the ring section (4142) of the first member (414) abuts against one face of the ring portion (4151) of the second member (415) and another gasket (417) is disposed therebetween. In this manner, good gas-tight effect between the first member (414) and the second member (415) can be achieved and output of gas stream from the gas pores (411) can be ensured.

Figure 7:
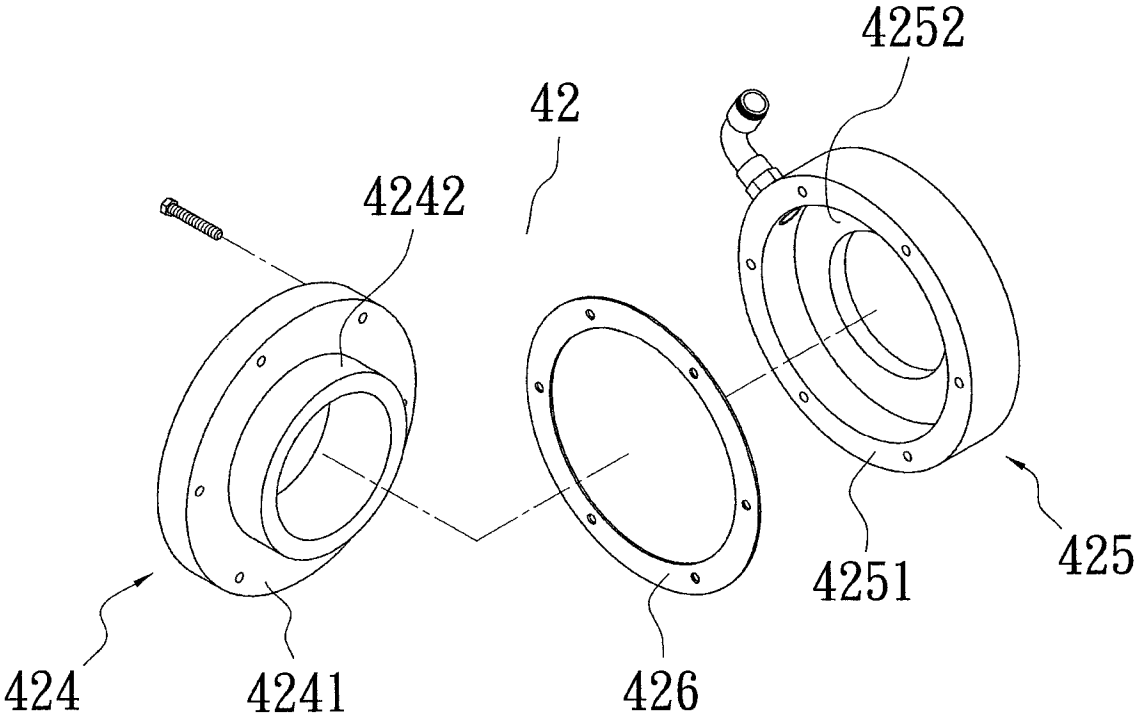
FIG. 7 is a view showing the structure of the gas-ring of the second embodiment of the present invention.
Figure 8:
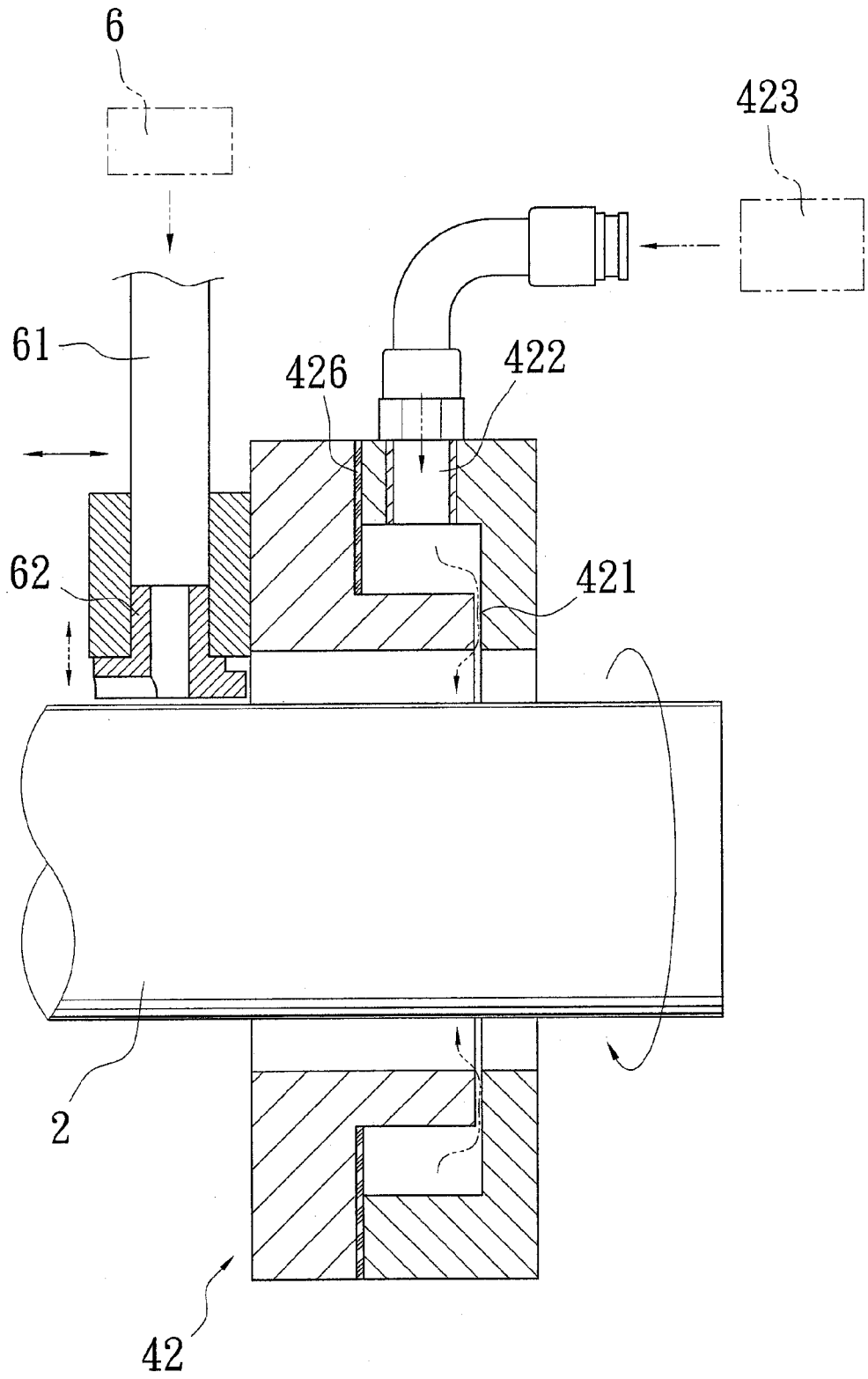
FIG. 8 is a side view showing the structure of the gas-ring and the circular workpiece of the second embodiment of the present invention.

Another one preferred design of the annular gas-stream generating device (4), as shown in FIGS. 7 and 8, is provided with an annular slit (421) on the inner face of the gas-ring (42), which communicates with a gas inlet opening (422). The gas inlet opening (422) is connected to a gas supply source (423) such that the high pressure gas stream is delivered out through the annular slit (421) to be an annular gas-stream.

In this case, the gas-ring (42) includes a first member (424) and a second member (425). The first member (424) is provided with a ring section (4242) on the base section (4241), while the second member (425) has a ring portion (4251) one end of which has an annular flange (4252) extending toward the axis, and the gas inlet opening (412) is provided on the ring portion (4251). When the first member (424) is fastened with the second member (425), one face of the base section (4241) of the first member (424) abuts against one end of the ring portion (4251) of the second member (425) and a gasket (426) is interposed therebetween. Simultaneously, one end of the ring section (4242) of the first member (424) abuts against one face of the ring portion (4251) of the second member (425) and the slit (421) is formed therebetween. In this manner, gas stream can be ensured to delivered out from the slit (421) between the first member (424) and the second member (425).

Figure 9:
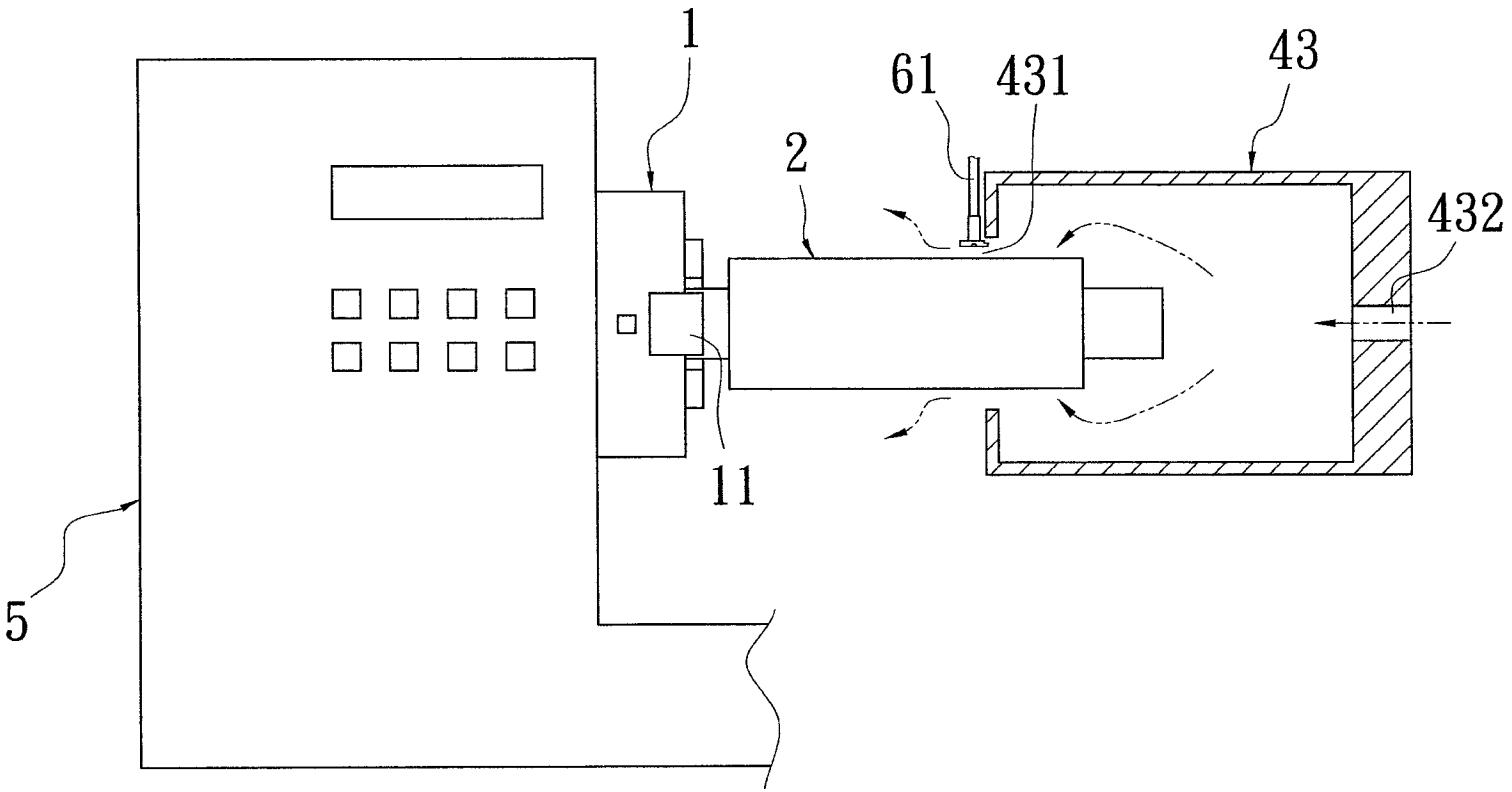
FIG. 9 is a side view showing the relationship between structure of the gas-ring and the circular workpiece of the third embodiment of the present invention.

Still another one preferred design of the annular gas-stream generating device (4), as shown in FIG. 9, has a hollow cylinder body (43). One end of the hollow cylinder body (43) has an opening (431) having a diameter slightly larger than that of the circular workpiece (2) such that the hollow cylinder body (43) can be put on the circular workpiece (2). The other end of the hollow cylinder body (43) is an input end (432) of high pressure gas. In this manner, annular gas-stream can be produced at a slit formed between the opening (431) of the cylinder body (43) and the circular workpiece (2).

When the annular gas-stream generating device (4) is implemented as above, the annular gas-stream generating device (4) is utilized in film coating operation on the outer surface of circular workpiece (2).

Figure 10:
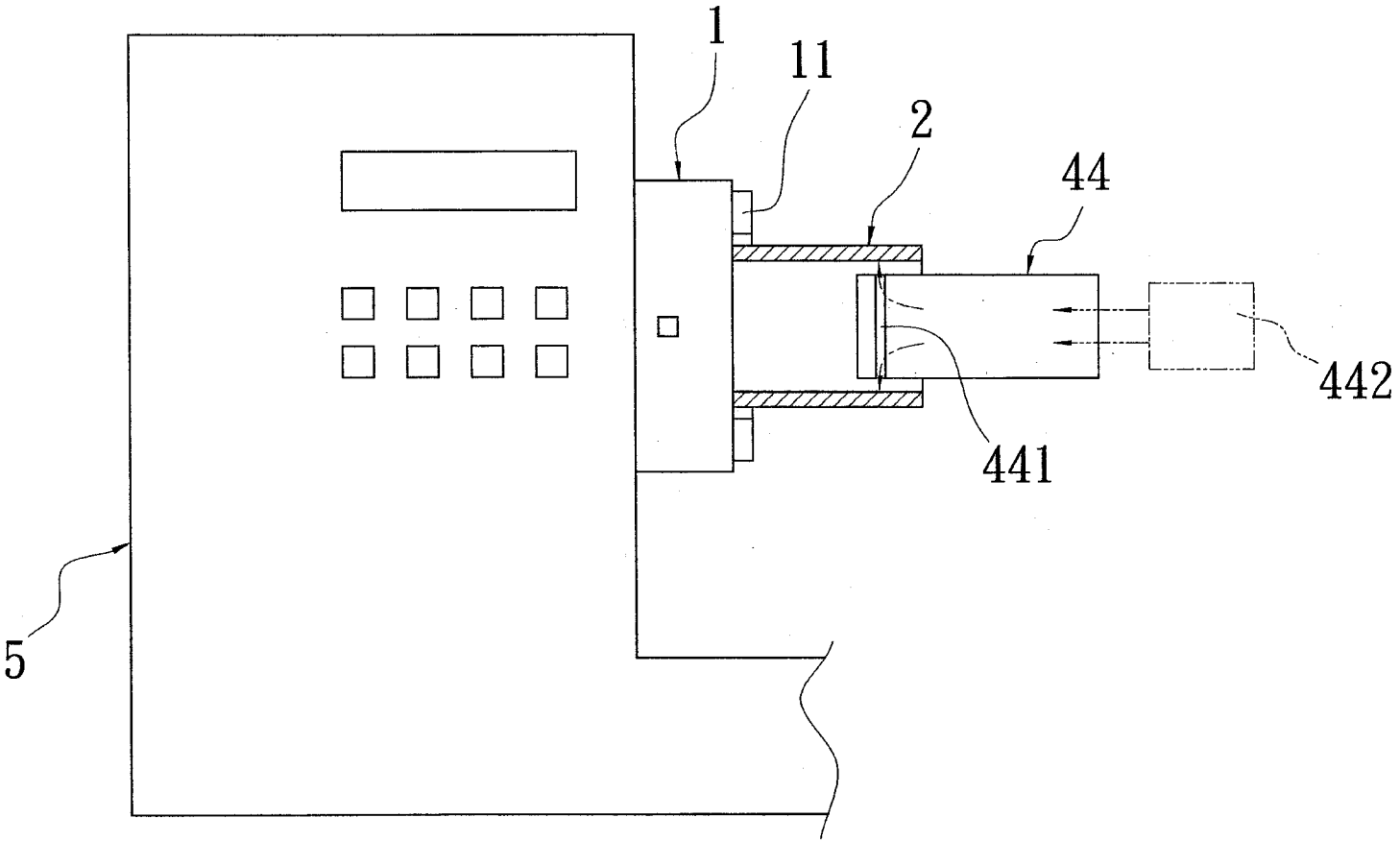
FIG. 10 is a side view showing the relationship between structure of the gas-ring and the circular workpiece of the fourth embodiment of the present invention.

Yet another preferred design of the annular gas-stream generating device (4), as shown in FIG. 10, is to provide an annular slit (441) on the outer surface of a hollow cylinder body (44). The annular slit (441) is in communication with the interior of the hollow cylinder body (44) which is connected to a gas supply source (442) such that the high pressure gas stream supplied from the gas supply source (442) is delivered out through the annular slit (421) to be an annular gas-stream. When the annular gas-stream generating device (4) is implemented as above, the annular gas-stream generating device (4) is utilized in film coating operation on the inner surface of circular workpiece (2).

Figure 11:
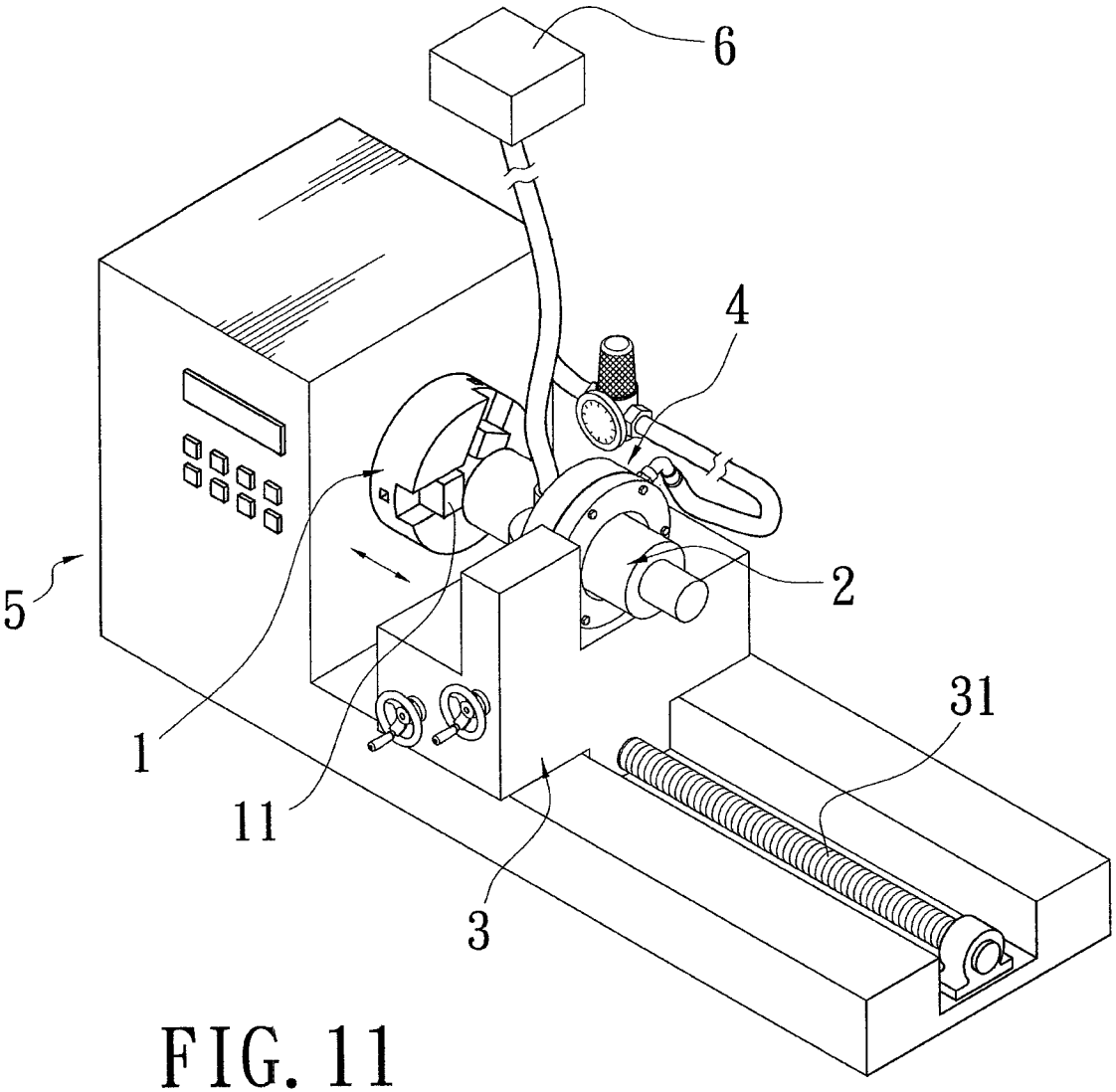
FIG. 11 is a schematic view showing the operation of squeezing the coating material coated on the surface of a circular workpiece by the annular high pressure gas stream in the first embodiment of the present invention.

When conducting coating on the surface of a circular workpiece (2), taking the embodiment utilizing the first preferring design of the annular gas-stream generating device (4) as example for description purpose, the circular workpiece (2) shown in FIG. 1 is disposed on the rotating mechanism (1) and is fixed in place by the chuck (11) of the rotating mechanism (1). In turn, the coating material is precoated on the circular workpiece (2) from the discharge opening (61) of the feedstock supply mechanism (6) Then, the circular workpiece (2) conducts self-spinning, as shown in FIGS. 3 and 11. The high pressure gas supplied from the gas supply source (413) enters into each gas pore (411) through the gas inlet opening (412) of the gas-ring (41) and is ejected out of each gas pore (411) from the interior, as shown in FIGS. 2 and 3. After the translational mechanism (3) guides the gas-ring (41) by the guide portion (31) toward the direction of the circular workpiece (2) and the circular workpiece (2) then enters into the gas-ring (41), the high pressure air ejected from the interior of the gas-ring (41) begins to squeeze the coating material coated on the surface of the circular workpiece (2) such that the coating material coated on the surface of the circular workpiece (2) can become flat and uniform.

Referring to FIG. 12, the coating is conducted under the conditions that the rotation speed of the circular workpiece (2) is 180 rpm, the viscosity of polymer solution being 1000 cps, the pressure of high pressure gas being 1 bar, and the gap between the annular gas-stream and the circular workpiece (2) being 2 mm. The film thickness measurement is conducted on several points of the surface of the circular workpiece (2) as shown in FIG. 12 (*c*), and the measured data are shown in FIG. 12 (*a*) expressed as table or in FIG. 12 (*b*) expressed as graph. It is confirmed by these data that a film coating having even thickness can be obtained by the technology of the present invention.

Further in the present embodiment, the rotating mechanism (1) is exemplified to be a lathe as shown in FIG. 1. The coating material is selected from: organic photoresist or UV resin, or any polymer material, organic material, plastic material, compound of any two above materials, or compound of more than two above materials. The high pressure gas can be air or pure nitrogen gas.

Figure 13:
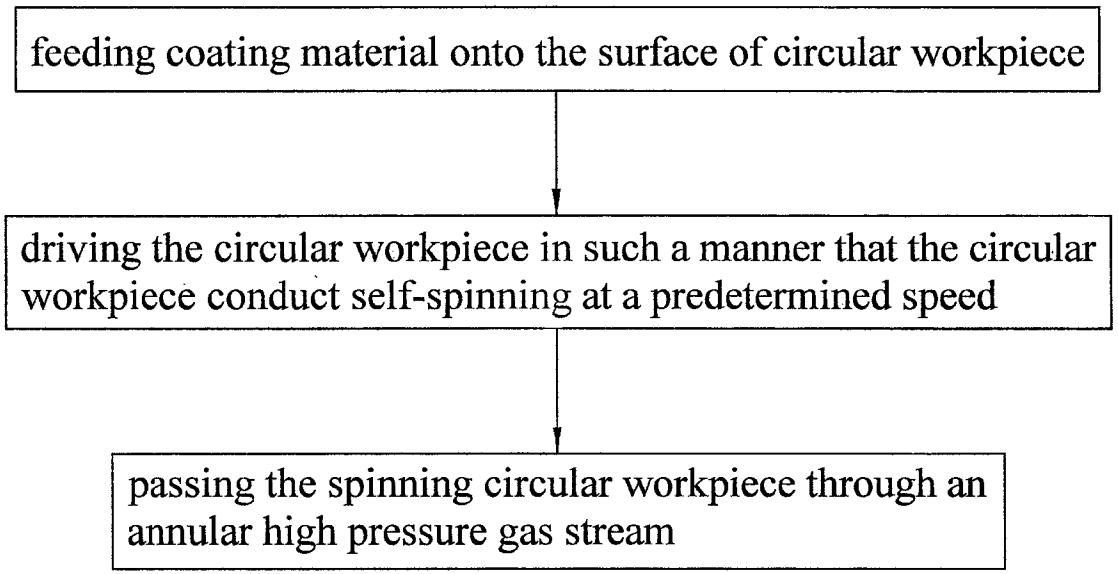
FIG. 13 is a flow chart showing the method for conducting film coating on the surface of spinning circular workpiece under action of gas pressure of the present invention.
Figure 14:
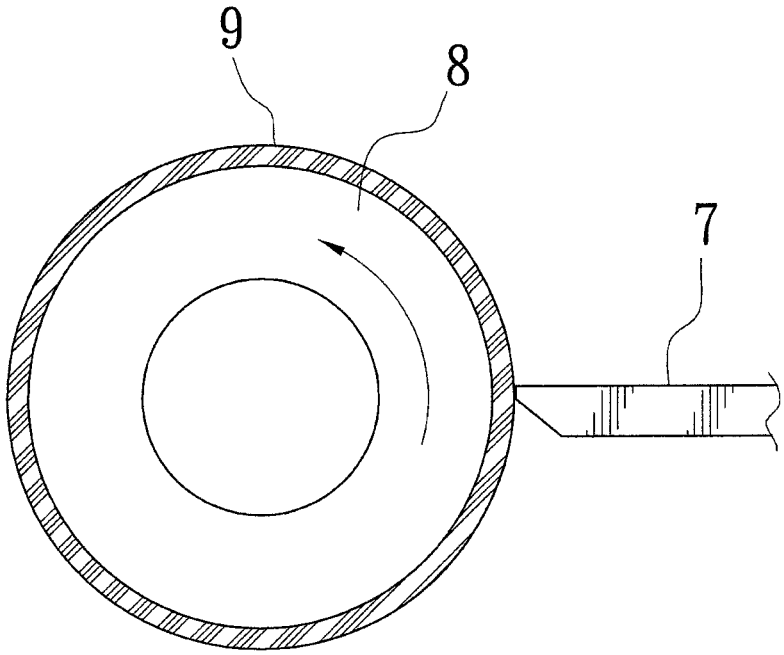
FIG. 14 is a schematic view showing the coating of polymer solution on the circular work by blade coating method.

Referring to FIG. 13, a schematic flow chart showing a preferring embodiment of a method for conducting film coating on the surface of spinning circular workpiece under action of gas pressure of the present invention is shown. The method for conducting film coating on the surface of spinning circular workpiece under action of gas pressure of this invention at least comprises following steps:

(A) feeding coating material onto the surface of circular workpiece;

(B) driving the circular workpiece in such a manner that the circular workpiece conduct self-spinning at a predetermined speed with its axis as the center;

(C) passing the spinning circular workpiece through an annular high pressure gas stream provided in radial direction of the circular workpiece such that the coating material coated on the surface of the circular workpiece is squeezed by the high pressure gas stream, the size of which can be adjusted.

Based on the foregoing implementation, the present invention has at least the advantages set forth below.

1. In the technology of conducting film coating on the surface of spinning circular workpiece under action of gas pressure, the circular workpiece is securely fixed on the rotating mechanism and is driven to conduct self-spinning. The discharge opening is disposed above the circular workpiece and the distance between the discharge opening and the circular workpiece can be adjusted such that the coating material is contacted with the spinning circular workpiece after it is output from the discharge opening, and the coating material is precoated on the surface of the circular workpiece by means of the self-spinning action of the circular workpiece. The discharge opening also can wipe off redundant material exceeding the height of the gap such that the coated material on the surface of the circular workpiece has a constant initial thickness dependent on the dimension of the gap between the discharge opening and the circular workpiece. The faster the rotation speed is, the bigger the frequency of circular workpiece's passage through the discharge opening becomes and the better the uniformity is. Hence, the rotation speed of the circular workpiece can determine the uniformity of the coating material on the circular workpiece and the rotation speed can be adjusted in digital manner.

2. In the technology of conducting film coating on the surface of spinning circular workpiece under action of gas pressure, the annular gas-stream generating device is provided on the translational mechanism. Hence, it is possible to set the translational movement speed of the translational mechanism so as to control the speed of the annular gas-stream generating device enclosing the circular workpiece.

3. In the technology of conducting film coating on the surface of spinning circular workpiece under action of gas pressure, the circular workpiece is clamped on the rotating mechanism by the chuck thereof. Therefore, it is not only easy in operation to hold the circular workpiece in place but also the stability after holding is high.

4. In the present invention, redundant coating material is guided and overflowed toward the forward direction [transverse direction] and the rotational direction [longitudinal direction]. Hence, the coating status of the coating material is flat and waste of material is avoided.

5. In the present invention, the contact portion between the nozzle and the circular workpiece is formed to have a blade-like function so that it can wipe off redundant coating material so as to reach the effect of surface coating having good uniformity and flatness.

What is claimed is:

1. A method for applying a film coating on a surface of a rotating cylindrical workpiece under action of gas pressure, wherein coating material is fed onto an inner or outer longitudinal part of said cylindrical workpiece with a circular cross section undergoing rotation including the steps of:

establishing an annular gas ring having a feedstock mechanism attached to said annular gas ring and surrounding a cross-section of the longitudinal part of said cylindrical workpiece; and displacing said annular gas ring with respect to said cylindrical workpiece for simultaneously coating said workpiece with said coating material and applying gas under pressure to said cylindrical surface whereby the coating material on said cylindrical workpiece is squeezed by the gas-stream so as to be distributed in an even and flat manner.

2. The method for conducting film coating on the surface of the rotating cylindrical workpiece under action of gas pressure as claimed in claim 1, wherein the gap between said cylindrical workpiece and the annular gas-stream is 0.5 mm to 2 mm.

3. The method for conducting film coating on the surface of the rotating cylindrical workpiece under action of gas pressure as claimed in claim 1, wherein the material of the cylindrical workpiece is one selected from: medium-carbon steel, high-carbon steel, any polymer material, organic material, plastic material, semiconductor material, metallic material, quartz, glass material, ceramic material, inorganic material, electrically conducting material, compound of any two above materials, or compound of more than two above materials.

4. The method for conducting film coating on the surface of the rotating cylindrical workpiece under action of gas pressure as claimed in claim 1, wherein the rotation of said cylindrical workpiece is conducted by a rotating mechanism.

5. The method for conducting film coating on the surface of the rotating cylindrical workpiece under action of gas pressure as claimed in claim 1, wherein said coating material is selected from: organic photoresist or UV resin, or any polymer material, organic material, plastic material, compound of any two above materials, or compound of more than two above materials.

6. The method for conducting film coating on the surface of the rotating cylindrical workpiece under action of gas pressure as claimed in claim 1, wherein the gas of said annular gas-stream is selected from air or pure nitrogen gas.

* * * * *